US009702665B1

(12) United States Patent
Rose, Jr. et al.

(10) Patent No.: US 9,702,665 B1
(45) Date of Patent: Jul. 11, 2017

(54) BALLISTIC SHADE SYSTEM

(71) Applicant: Burose, LLC, Rocky Mount, NC (US)

(72) Inventors: Dillon Rose, Jr., Rocky Mount, NC (US); James W. Burns, Lookout Mountain, TN (US)

(73) Assignee: Burose, LLC, Rocky Mount, NC (US)

( * ) Notice: Subject to any disclaimer, the term of this patent is extended or adjusted under 35 U.S.C. 154(b) by 0 days.

(21) Appl. No.: 15/225,257

(22) Filed: Aug. 1, 2016

(51) Int. Cl.

| | |
|---|---|
| ***F41H 5/24*** | (2006.01) |
| ***E04H 9/04*** | (2006.01) |
| ***E06B 5/10*** | (2006.01) |
| ***E06B 9/68*** | (2006.01) |
| ***E06B 9/70*** | (2006.01) |
| ***E05G 5/00*** | (2006.01) |

(52) U.S. Cl.
CPC ..... *F41H 5/24* (2013.01); *E04H 9/04* (2013.01); *E05G 5/003* (2013.01); *E06B 5/10* (2013.01); *E06B 9/68* (2013.01); *E06B 9/70* (2013.01)

(58) Field of Classification Search
CPC .. F41H 5/24; E05G 5/00; E05G 5/003; E05G 5/006; E05G 5/02
USPC ..... 109/11, 12, 13, 14, 15
See application file for complete search history.

(56) References Cited

U.S. PATENT DOCUMENTS

| | | | | |
|---|---|---|---|---|
| 983,663 A * | 2/1911 | White | E06B 9/88 109/13 |
| 1,487,926 A * | 3/1924 | Evans | E05G 5/02 109/3 |
| 4,235,491 A * | 11/1980 | Korber | E05G 5/006 109/4 |
| 6,886,299 B2 | 5/2005 | Gower | |

FOREIGN PATENT DOCUMENTS

| | | | |
|---|---|---|---|
| AU | 2009201524 A1 | | 12/2009 |
| DE | 34 07 580 | * | 9/1985 |
| FR | 2 993 307 | * | 1/2014 |

OTHER PUBLICATIONS

"Safe Zone Ballistics LLC.—Leaders in Blast Protection", http://ww.safezoneballistics.com/blast-resistant.html, Jun. 20, 2016.

* cited by examiner

*Primary Examiner* — Stephen M Johnson
(74) *Attorney, Agent, or Firm* — James G. Passé; Passé Intellectual Property, LLC

(57) ABSTRACT

The present invention relates to a ballistic shade system which provides a means for rolling up and down ballistic material and holding it in place during a ballistic event.

6 Claims, 4 Drawing Sheets

BALLISTIC SHADE SYSTEM

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a ballistic system. In particular, it relates to a roller system for utilizing ballistic material to cover a building opening, such as a door or window.

Description of Related Art

The more frequent occurrence of intruders in schools, businesses, government facilities, and the like, has highlighted safety needs for people working or using such facilities. Intruders these days are armed with various versions of high powered rifles that do tremendous damage, as well as make most locking devices ineffective. Facilities are constantly attempting to prevent an intruder from entering classrooms, offices and the like. When dealing with an intruder, many places go into a lockdown situation wherein people remain in the places/rooms where they are. The responders can take an average of 18 minutes before they can reach and deal with the situation, if no security is readily present keeping the occupants of a room or building safe from intruder entry is the critical priority and represents the most effort while waiting for responders. Effective entry prevention, as well as protection from penetration of bullets (especially high powered bullets), is needed to allow time for the responders to arrive and protect the occupants in the room or building.

In schools and most buildings there are many kinds of doors and windows of various shapes. Some swing outward, while others swing inwards. In addition, some doors are double doors that open in the middle of the two doors, either in or out. Windows as well take on various shapes, though most of these are usually some rectangular form.

Many rooms in these situations have a window in the door or next to the door, making it relatively easy to break the window and reach in and unlock the door and open it with the door knob. These doors and windows are easy to see through and allow an intruder to do great damage, even if the door remains locked and closed.

The devices attempting to deal with this type of situation have used various approaches. Devices to prevent entry, metal roll-up doors, door locks, and the like have all been tried with various levels of effectiveness. Many ballistic materials are available, many of them, like Kevlar®, are solid sheets and are not flexible making them unsuitable for door and window protection. A new generation of more flexible ballistic materials are available, such as those made by Safe Zone Ballistics, LLC, and, while they are very flexible, they however cannot be just placed on standard shade or other roller door/window devices and remain effective ballistic materials. Accordingly, there needs to be a new system for utilizing this ballistic material effectively to prevent ballistic weapon entry of doors and windows.

BRIEF SUMMARY OF THE INVENTION

The present invention is the novel ballistic shade system which overcomes the problems inherent with other systems for ballistic protection. It has been discovered that by the combining flexible ballistic material with a drive system, using teeth on both the drive roller and on a belt on the ballistic material (that also fits into the side tracks) that the ballistic material is delivered evenly and a with a ballistic hit, is difficult to dislodge, as noted in the tests the invention has passed listed below.

Accordingly, in an embodiment, there is a ballistic shade system designed to cover an opening in an interior wall of a building and to provide ballistic protection for the opening when the shade system is in use, comprising:

a) a flexible ballistic material rolled up on a belt pinch roller, the shade having a length and a width;
b) a timing belt having guide teeth positioned on each of an inside length edge of the ballistic material;
c) a motorized pulley on each side of the ballistic material having drive teeth positioned to match the guide teeth, wherein the pulley is designed to drive the ballistic material on and off of the belt pinch roller;
d) a plurality of shade roller guides; and
e) a pair of side tracks mounted on the wall next to the opening, designed and positioned to guide the length edges of the shade as the ballistic material is driven on and off the belt pinch roller.

DETAILED DESCRIPTION OF THE INVENTION

Figure 1:
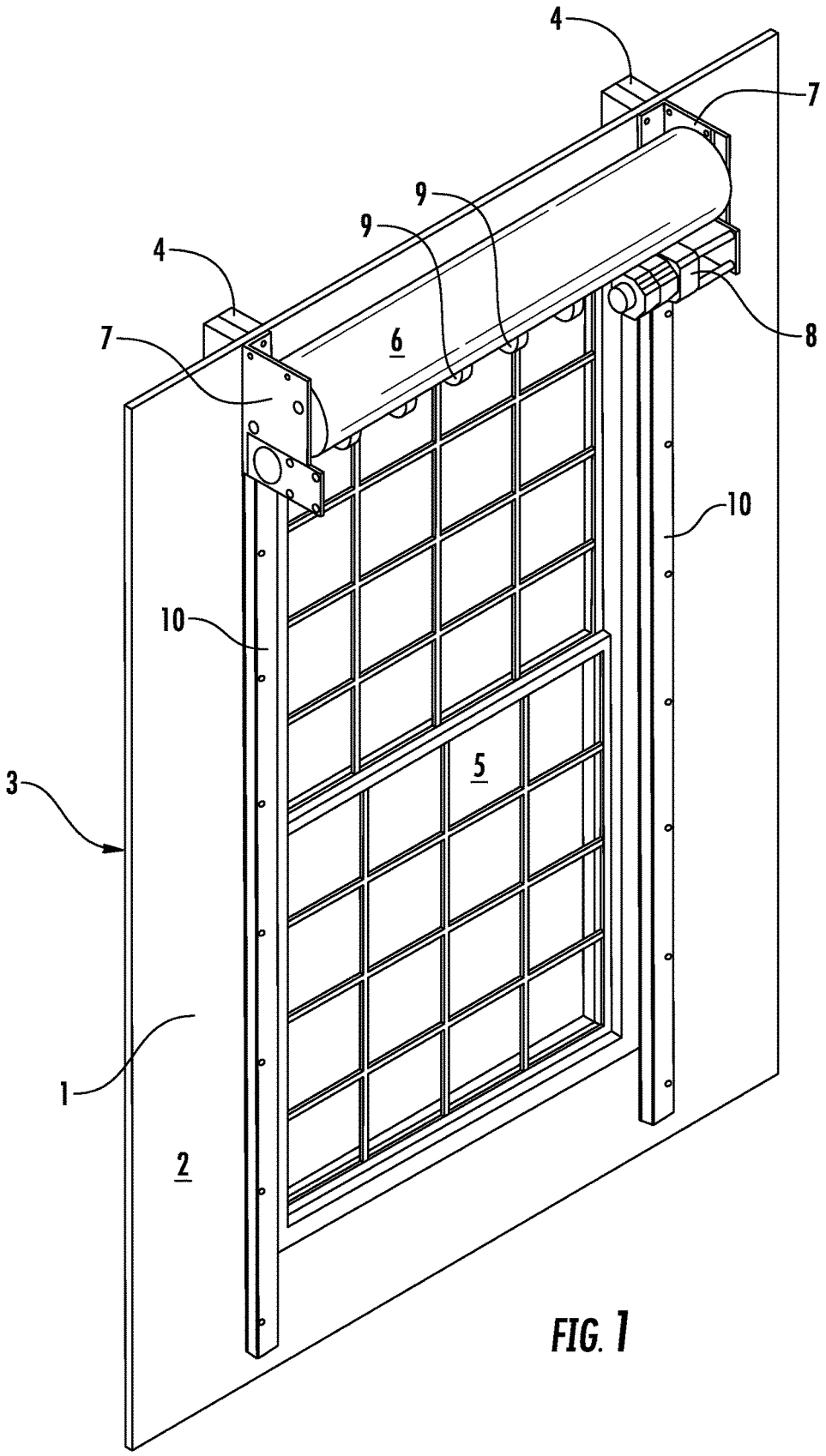
FIG. 1 is a perspective view of the present system mounted on the inside surface of an outside wall, having a window as the opening.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

References throughout this document to "one embodiment", "certain embodiments", and "an embodiment" or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "ballistic shade system" refers to material designed to provide ballistic protection to an opening in a wall of a building, the ballistic material which can be deployed or placed out of the way using the entire system of the invention. Unlike standard roller shades or roll up metal doors, like garage doors or the like, in order to provide ballistic protection, the system has to be able to hold the ballistic material in place when engaged, such as when hit by bullets, a blast, or the like, during an entry attempt. If not held in place, the material is blown aside, providing easy entry. While no system is totally impervious or completely resistant to high powered weapons or explosives, if protection is provided for a period of time (e.g. half an hour, an hour, 2 hours or more), that provides sufficient time for authorities or other help to arrive and control the situation from outside the building. The present ballistic shade system is a roller system which, when it engages ballistic material over the opening in a wall of a building (i.e. rolled down to cover the opening), provides protection from entry due to such ballistic assault.

As used herein, the term "opening in an interior wall of a building" refers to standard openings which appear in both the exterior walls and interior walls of a building. Such openings include windows, doors, pass-throughs and the like. The system is designed to be mounted on the interior surface of a wall, e.g. the interior wall of an exterior wall. For example, the inside wall inside an office or the like.

As used herein, the term "ballistic material" refers to blast and bullet resistant flexible material that can be rolled up but can still provide protection, unlike materials (like Kevlar®) which cannot. An example is the material made by Safe Zone Ballistics LLC, but the present invention includes any such material. In one embodiment, ballistic material is material that provides protection to at least NIJ III-A level or to 7.62 level. It can also be low-hazard blast resistant. Typically, such material has a weight of at least about 0.8 lbs per sq ft though some materials are about 3.3 lbs per sq ft or more.

As used herein, the term "ballistic protection" refers to a system wherein the system protects entry from a bullet or the like through an opening in a wall when the system is engaged covering the opening.

As used herein, the term "belt pinch roller" refers to a roller that the ballistic material is rolled up on. The ballistic material is rolled on or off (providing the material up or down over the opening) by a motor. Wherein the roller has a timing pulley with teeth that match the teeth on the edges of the ballistic material to hold it in place on the track. There can be teeth on one or both sides of the roller, so that each side is grabbed and driven evenly. In one embodiment, there are teeth in the track as well to hold the curtain in place.

As used herein, the term "guide teeth" refers to teeth on the timing pulley and in the edge of the ballistic material on the timing belt (as shown in the drawings) positioned to guide the ballistic material evenly in the side tracks and to keep the material in the side tracks when hit by a ballistic event, such as a bullet or a blast.

As used herein, the term "timing belt" refers to guide teeth at the end of the roller that grab corresponding teeth on the ballistic material for bringing it up and down and keeping the ballistic material in place.

As used herein, the term "motorized pulley" refers to a motorized belt drive for turning the roller one way or the other. The motor can be AC or DC and is a reversible motor for going in both directions. The pulley engages both the motor and the roller in a normal matter for raising and lowering the curtain material.

As used herein, the term "shade roller guides" refers to wheels which help move the ballistic material up and down without bunching or the like, as shown in the figures. The guides are mounted on a rod driven by the pulley on either side of the unit. Depending on the width of the material used, the guides are placed every 6 to 8 inches, so there are between about 3 and 10 rollers (6 in the drawings) used in this embodiment of the invention. The guides can be made of polyoxymethylene or other similar hard durable plastic material.

As used herein, the term "side tracks" refers to channels designed to be mounted to the left and right of the opening in the wall. They are designed to channel the edges of the ballistic material up and down, while holding the edges in and keeping them from pushing out of the channel when a ballistic event hits the ballistic material.

DRAWINGS

Now referring to the drawings, FIG. 1 is a perspective view of the present system mounted on the inside surface of an outside wall, having a window as the opening (though this could be a door or any other wall opening, or could be an interior wall and the inside surface of that e.g. inside an office) in this view The ballistic shade system 1 is mounted on the interior surface 2 of wall 3. In this view, the shade system 1 is mounted to the wall studs 4 of the window 5. In this view, we can see the system 1 in the undeployed, or stowed, view with ballistic material 6 rolled up on a belt pinch roller (as seen in the next figure, FIG. 2). Decorative pieces 7 hide the roller from view. A motor 8 which uses a pulley is used to roll the shade 6 up in a stowed position and down to an employed position. Shade roller guides 9 are shown, which will aid in the deployment of shade 6 when the motor 8 is engaged to lower the shade. Left and right tracks 10 are shown for holding the edges of the shade in place especially during a ballistic impact and to guide the shade evenly into a deployed state.

Figure 2:
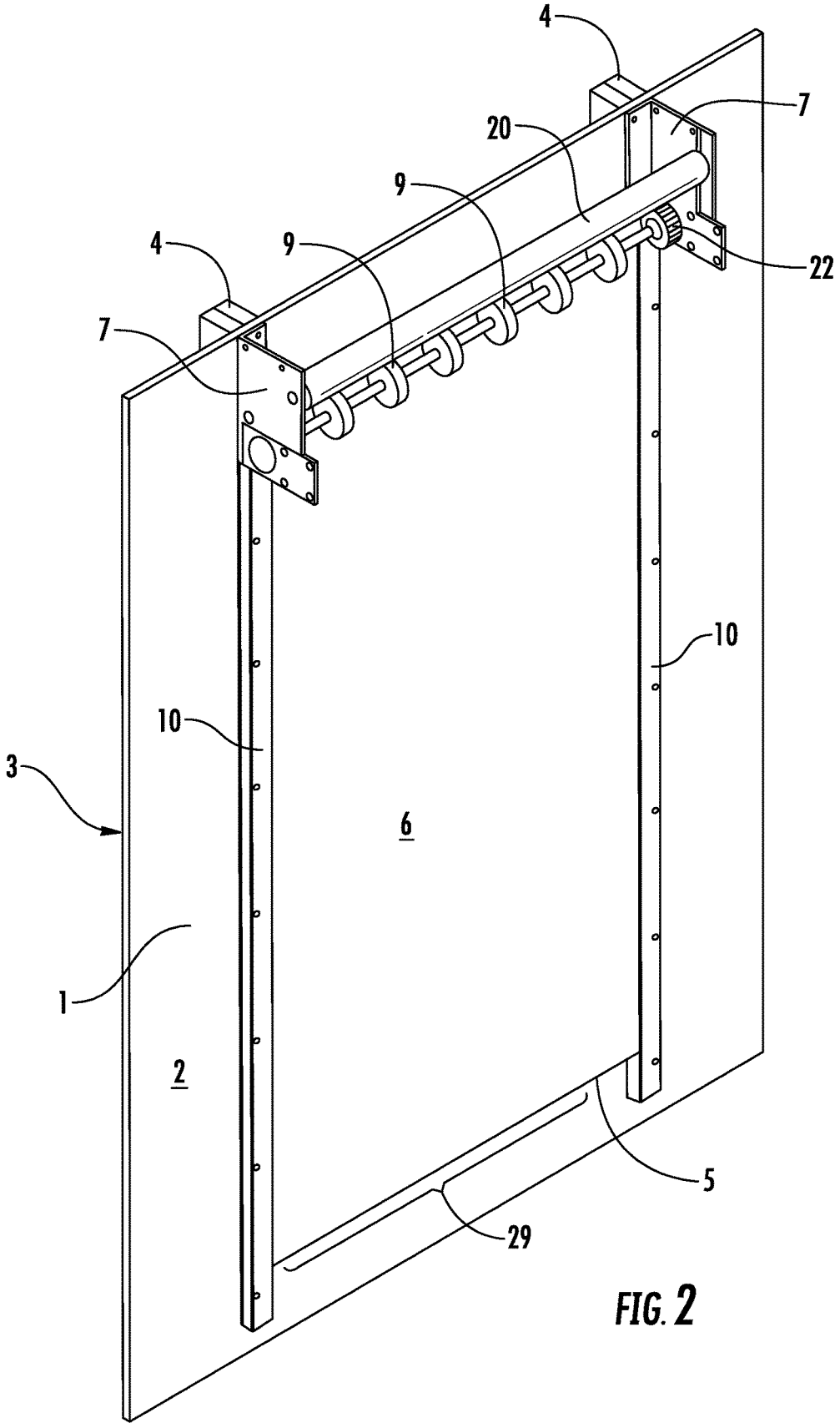
FIG. 2 shows the ballistic shade system in the deployed configuration.

FIG. 2 shows the ballistic shade system 1 in the deployed configuration. In this view, the ballistic material 6 is rolled off the pinch belt roller 20. The left and right edges of the length of the shade are seen inside the pair of side tracks 10. In this view, the motor has been removed for viewing clarity and the drive teeth 22 of the motorized pulley on the right side (and identically on the left side, but hidden from view) will drive the timing belt on the left and right edge of the ballistic material to aid in driving the ballistic material and keeping it in the tract. In this view, the window 5 is completely covered, thus preventing a ballistic object or blast from entering the room. Optional bottom bar 29 at the bottom of the ballistic material is also shown.

Figure 3:
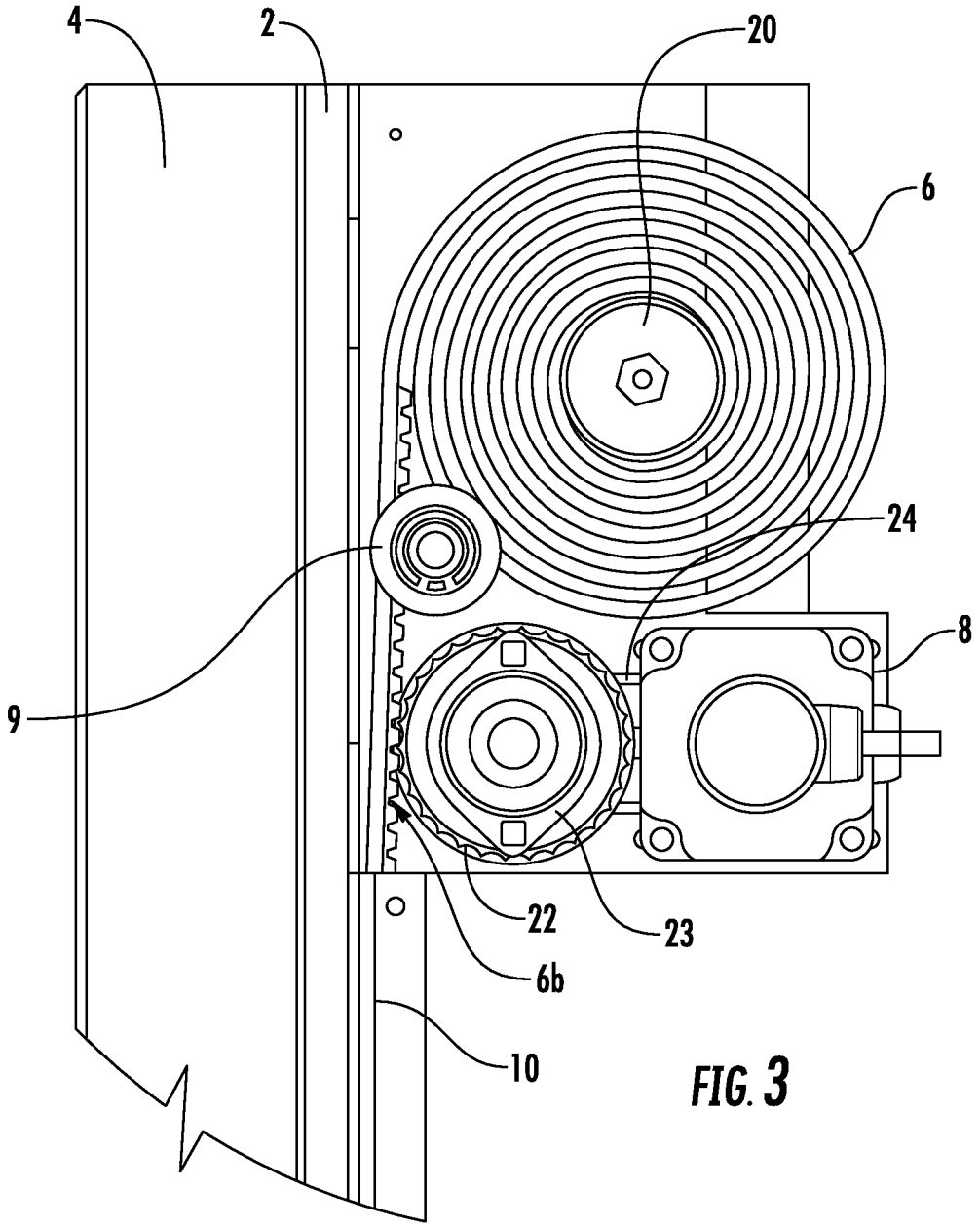
FIG. 3 is a side view of the drive mechanics of the system.

FIG. 3 is a side view of the drive mechanics of the system. In this view, the ballistic material 6 is in the process of being rolled off the pinch belt roller 20. The motor 8 using belt 24 drives motorized pulley 23 having drive teeth 22. The drive teeth 22 engage the guide teeth 6*b* of the timing belt mounted on the inside edge of the ballistic material 6, thus driving the material and helping to keep the material in the side tracks 10 during a ballistic strike on the outside of the material.

Figure 4:
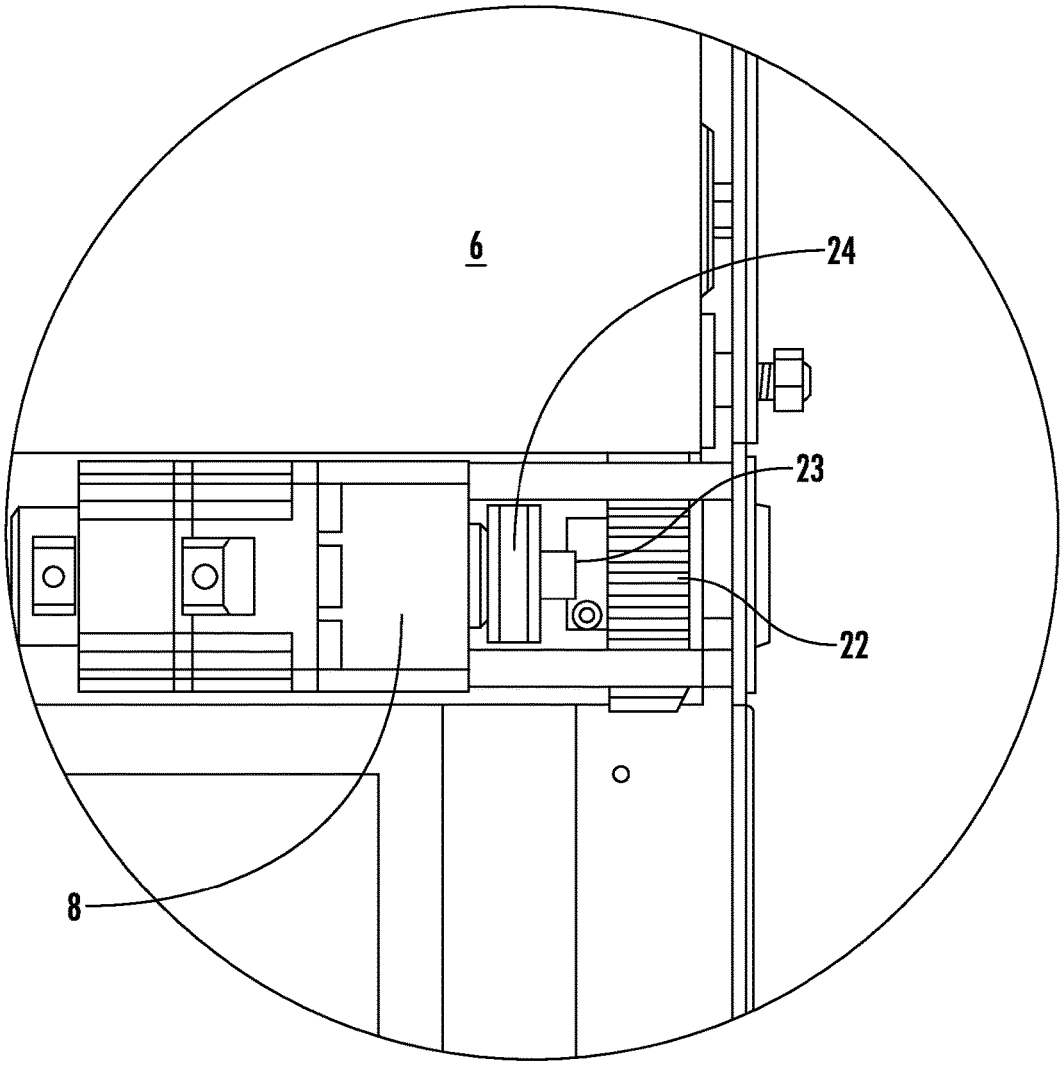
FIG. 4 is a frontal view of the drive mechanism of the motorized pulley.

FIG. 4 is a frontal view of the drive mechanism of the motorized pulley. In this view, the motor 8 drive belt 24 is seen and connected to the motorized pulley 23.

Now in use, the motor is engaged and the pulley rotates the motorized pulley. The teeth on the pulley engage with the guide teeth of the timing belt mounted along the length of the edge(s) of the ballistic material for driving it. The ballistic material is guided off the roller and guided by the guide wheels into the side tracks till the opening is entirely covered. The timing belt ends up positioned inside the side tracks and aids in preventing the edges of the ballistic material from pulling out of the side tracks when the outside surface of the ballistic material is hit by a ballistic projectile or the like. In reversing, the motor rolls the ballistic material back up on the roller.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A ballistic shade system designed to cover an opening in an interior wall of a building and to provide ballistic protection for the opening when the shade system is in use, comprising:

a) a flexible ballistic material rolled up on a belt pinch roller, the shade having a length and a width;

b) a timing belt having guide teeth positioned on each of an inside length edge of the ballistic material;

c) a motorized pulley on each side of the ballistic material having drive teeth positioned to match the guide teeth, wherein the pulley is designed to drive the ballistic material on and off of the belt pinch roller;

d) a plurality of shade roller guides; and e) a pair of side tracks mounted on the wall next to the opening, designed and positioned to guide the length edges of the shade as the ballistic material is driven on and off the belt pinch roller.

2. The system according to claim 1 wherein a bottom edge of the ballistic material has a bottom bar.

3. The system according to claim 1 wherein there is a timing belt retention area.

4. The system according to claim 1 wherein the opening is a door or window.

5. The system according to claim 1 wherein a motor drives the motorized pulley with a drive belt.

6. The system according to claim 1 which is positioned on the interior wall of a building.

* * * * *